US005577888A

United States Patent [19]

Capdevila et al.

[11] Patent Number: 5,577,888

[45] Date of Patent: Nov. 26, 1996

[54] HIGH EFFICIENCY, LOW-NOISE, AXIAL FAN ASSEMBLY

[75] Inventors: Hugo Capdevila, London; Eric Bartlett, St. Thomas; John Pharoah, Victoria; William Gallivan, London, all of Canada

[73] Assignee: Siemens Electric Limited, London, Canada

[21] Appl. No.: 493,872

[22] Filed: Jun. 23, 1995

[51] Int. Cl.[6] ..... F04D 29/38; F04D 29/54

[52] U.S. Cl. ..... 415/210.1; 415/211.2; 415/220; 416/189; 416/238; 165/122

[58] Field of Search ..... 415/173.6, 210.1, 415/211.2, 220, 208.2; 416/189, 169 A, 223 R, 238; 165/122

[56] References Cited

U.S. PATENT DOCUMENTS

| | | | |
|---|---|---|---|
| 16,547 | 2/1857 | Marshall . | |
| 562,020 | 6/1896 | Peabody . | |
| 1,062,258 | 5/1913 | Schlotter . | |
| 1,408,715 | 3/1922 | Seelig et al. . | |
| 1,795,588 | 3/1931 | Wilson . | |
| 1,993,158 | 3/1935 | Funk . | |
| 2,154,313 | 4/1939 | McMahan | 415/208.2 |
| 2,219,499 | 10/1940 | Troller | 415/210.1 |
| 2,397,169 | 3/1946 | Troller et al. | 415/210.1 |
| 2,628,019 | 2/1953 | Koch . | |
| 2,687,844 | 8/1954 | Woodward . | |
| 3,168,235 | 2/1965 | Valdi . | |
| 3,173,604 | 3/1965 | Sheets et al. | 415/220 |
| 3,481,534 | 12/1969 | Price . | |
| 3,680,977 | 8/1972 | Rabouyt et al. . | |
| 3,995,970 | 12/1976 | Nobuyuki . | |
| 4,181,172 | 1/1980 | Longhouse . | |
| 4,329,946 | 5/1982 | Longhouse . | |
| 4,358,245 | 11/1982 | Gray | 416/189 R |
| 4,396,351 | 8/1983 | Hayashi et al. . | |
| 4,459,087 | 7/1984 | Barge . | |
| 4,548,548 | 10/1985 | Gray, III | 415/210.1 |
| 5,244,347 | 9/1993 | Gallivan et al. | 415/211.2 |
| 5,326,225 | 7/1994 | Gallivan et al. | 416/189 |
| 5,399,070 | 3/1995 | Alizadeh | 416/189 |

FOREIGN PATENT DOCUMENTS

| | | | |
|---|---|---|---|
| 1150409 | 4/1985 | U.S.S.R. | 415/211.2 |

OTHER PUBLICATIONS

Axial Flow Fans and Ducts, R. A. Wallis, John Wiley & Sons, 1983. Sec. 7.5, 8.7, 15.1, 15.2, 16.3.1.

Axial Flow Fans Design and Practice, R. A. Wallis, Academic Press, 1961. Sec. 1.2, 1.3, 1.4, 1.5, 7.6, 7.7, 11.1, 17.2.2, 17.2.3, 17.2.4.

Fluid Mechanics, Thermodynamics of Turbomachinery, S. L. Dixon, Pergamon Press, 1966. pp. 104–109, 124–125.

Computational Fluid Dynamics Analysis of Axial Flow Fans for Automotive Cooling Systems, H. Capdevila, J. Pharoah, Siemens Electric Ltd., London, Ontario, Canada.

*Primary Examiner*—James Larson

[57] ABSTRACT

A high efficiency fan and stator arrangement for generating an airflow through a heat exchanger is disclosed herein. The fan is rotated about its rotational axis by an electric motor, and includes eight blades extending radially from a hub to a circular band. Each fan blade has a stagger angle and chord lengths which vary along the span of the blades. Each fan blade also includes a trailing edge having a flat surface extending along the edge. The flat surfaces of each fan blade are coincident with a plane perpendicular to the rotational axis. The fan produces an airflow when rotated about the rotational axis, wherein a component of the airflow occurs at a first angle to the rotational axis. The fan support has a central bearing support and twenty elongated airfoils extending radially outward from the bearing support. Each airfoil has substantially the same length as the fan blades and includes a curved airflow guiding surface having a leading edge and a trailing edge downstream from the leading edge. The curve of the guiding surface is a generally circular arc with a tangent to the guiding surface at the leading edge substantially at the first angle to the rotational axis, and a tangent to the trailing edge at a second angle to the rotational axis less than the first angle. The fan support is located downstream of the heat exchanger to guide the airflow produced by the fan through the heat exchanger.

36 Claims, 6 Drawing Sheets

HIGH EFFICIENCY, LOW-NOISE, AXIAL FAN ASSEMBLY

FIELD OF THE INVENTION

The present invention generally relates to airflow generators used to produce an airflow across an automotive heat exchanger. In particular, the present invention relates to an axial fan having an improved blade configuration which when combined with the fan motor support and an upstream or downstream heat exchanger improves fan efficiency and reduces noise.

BACKGROUND OF THE INVENTION

Over the last 20 years, front wheel drive automobiles have increased in popularity to the point where the majority of new automobiles sold are front wheel drive. It is now well known that one of the most effective transmission and engine arrangements for front wheel drive cars utilizes a transmission and engine disposed at the front of the automobile, with the axis of the engine crank shaft being generally parallel with the front of the automobile and perpendicular with the rotational axis of the radiator cooling fan. However, this arrangement no longer permits the use of a fan mechanically driven directly from the engine as was done with most rear wheel drive automobiles. More specifically, rear wheel drive automobiles typically supported the engine with the longitudinal axis of the engine crank shaft perpendicular with the front of the automobile and parallel with the rotational axis of the radiator cooling fan.

Accordingly, front wheel drive automobiles normally use an electric motor to rotate the radiator cooling fan. These electric motors are powered by the automobile battery, alternator, and operate during engine operation (i.e. while the battery is charged by the alternator) or, in many cases after the engine has been turned off. Thus to conserve battery life, reduce power consumption and prevent inadvertent battery discharge, it is important that fans designed for this use produce the maximum air flow to cool the radiator for a given amount of energy applied to the motor. In addition to conserving energy, it is important to provide a radiator fan which is quiet during operation.

Various shrouding, fan and fan support designs have been devised for radiator and engine cooling to reduce fan-generated noise and to move air more efficiently. Among these are shroud assemblies fixed with respect to the radiator having cylindrical rings within which the fan rotates, banded fans, cylindrical ring and fan band combinations which interact to improve performance, and fan motor support fins which modify air flow using fan and stator configurations of the type described in Axial Flow Fans and Ducts, Wallis, R. Allen, pp. 231–241, John Wiley & Sons, Inc. (1983) (hereinafter "the Article").

In general, the Article teaches the design of a stator (e.g. radiator fan support) which uses electric fan motor supports having vane shapes such as, for example, those disclosed in U.S. Pat. No. 4,548,548. As discussed in the Article, "inadequate aerodynamic consideration of the consequences of certain bearing support and/or rotor drive systems often leads to operational problems. For example, the electric drive motor is often mounted on a bench plate spanning the duct, incorporating one or more radial stiffening plates. This limited array of plates is assumed, incorrectly, to perform a flow-straightening function. Instead flow separation from each plate leading edge will lower fan efficiency and create downstream flow problems." (The Article, p. 37.)

In addition to using various designs for stator supports, attempts have been made at also modifying fan blade designs to reduce noise, and increase efficiency. However, there still is a need for improved fan blade designs used in combination with airfoil shaped stator supports to move air past a radiator with improved efficiency and reduced noise.

SUMMARY OF THE INVENTION

The present invention provides an airflow generator of the type including a fan. The fan includes a plurality of radially-extending fan blades configured to produce an airflow when the fan is rotated about its rotational axis, wherein a component of the airflow occurs at a first angle to the rotational axis. The generator also includes a fan support having a central bearing support and a plurality of elongated airfoils extending radially outward from the bearing support. Each airfoil includes a curved airflow guiding surface having a leading edge, and a trailing edge downstream from the leading edge. A tangent to the guiding surface at the leading edge is substantially at the first angle to the rotational axis, and a tangent to the trailing edge is at a second angle to the rotational axis less than the first angle. The fan is supported for rotation about its rotational axis by an appropriate bearing and shaft assembly such as that in an electric motor.

Another configuration of the airflow generator includes a fan including a hub, a circular band and a plurality of fan blades extending radially from the hub to the circular band. Each fan blade has a variable stagger angle which is at its minimum value at a first predetermined distance from the hub less than the length of the blade, and each fan blade has a variable chord length which is at its maximum value at a second predetermined distance from the hub less than the length of the blade. When rotated about the rotational axis, the fan produces an airflow component at an angle to the rotational axis. The generator also includes a fan support having a plurality of airfoils extending radially outward from a bearing support. Each airfoil is configured to guide a component of the airflow toward a path generally parallel with the rotational axis. As with the first generator configuration, the fan is supported for rotation about its rotational axis by an appropriate bearing and shaft assembly such as that in an electric motor.

The present invention also provides a heat exchanger assembly including a fan supported by a shaft for rotation about its rotational axis. The fan includes a hub, a circular band and a plurality of fan blades extending radially from the hub to the circular band. Each fan blade has a variable stagger angle which is at its minimum value at a first predetermined distance of between 20 and 70 percent of the blade length from the hub, and a variable chord length which is at its maximum value at a second predetermined distance of between 20 and 70 percent of the blade length from the hub. The fan produces an airflow when rotated about the rotational axis with a component thereof which occurs at a first angle to the rotational axis. The generator also includes a fan support having a central bearing support and a plurality of elongated airfoils extending radially outward from the bearing support. Each airfoil includes a curved airflow guiding surface having a leading edge and a trailing edge downstream from the leading edge, wherein a tangent to the guiding surface at the leading edge is substantially at the first angle to the rotational axis, and a tangent to the trailing edge is at a second angle to the rotational axis less than the first angle. The fan support is supported relative to a heat exchanger to guide the airflow produced by the fan through the heat exchanger.

Another configuration of the heat exchanger assembly includes a fan supported for rotation about its rotational axis by an electric motor. The fan includes a hub, a circular band and eight fan blades extending radially from the hub to the circular band. Each fan blade has a variable stagger angle which is at its minimum value at a first predetermined distance of between 20 and 70 percent of the blade length from the hub, and a variable chord length which is at its maximum value at a second predetermined distance of between 20 and 70 percent of the blade length from the hub. Each fan blade also includes a trailing edge having a flat surface extending along at least 50% thereof. The flat surfaces of each fan blade are coincident with a plane perpendicular to the rotational axis. The fan produces an airflow when rotated about the rotational axis, wherein a component of the airflow occurs at a first angle to the rotational axis. The assembly also includes a fan support having a central bearing support and twenty elongated airfoils extending radially outward from the bearing support. Each airfoil has substantially the same length as the fan blades and includes a curved airflow guiding surface having a leading edge and a trailing edge downstream from the leading edge. The curve of the guiding surface is a generally circular arc, a tangent to the guiding surface at the leading edge is substantially at the first angle to the rotational axis, and a tangent to the trailing edge is at a second angle to the rotational axis less than the first angle. The fan support is located downstream of a heat exchanger to guide the airflow produced by the fan through the heat exchanger, and at least one airfoil is shaped to cover the upstream side of an electric conductor connected to the electric motor.

DETAILED DESCRIPTION OF THE PREFERRED EMBODIMENT

Figure 1:
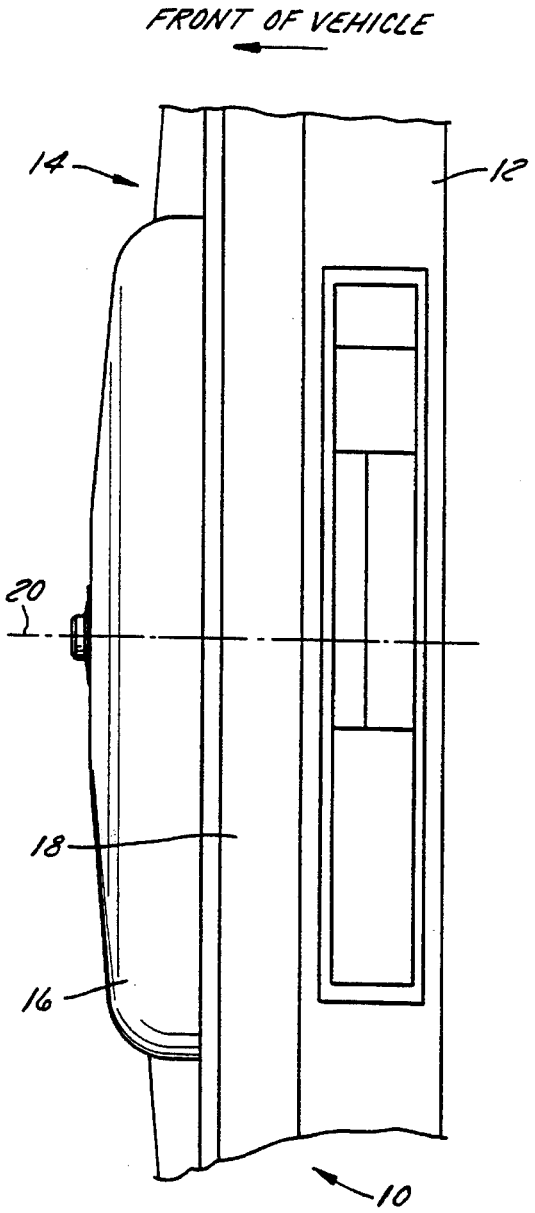
FIG. 1 is a partial schematic top view of a heat exchanger assembly including an airflow generator and heat exchanger.

Referring to FIG. 1, a heat exchanger assembly 10 includes a heat exchanger 12 and an airflow generator 14. Airflow generator 14 includes a fan 16 and a fan support 18. In general, heat exchanger 12 may be the radiator, a condensor, an intercooler, or combination thereof from an automobile of the type which is an air-to-liquid heat exchanger. Upon rotation of fan 16 about its rotational axis 20, an airflow is generated in a direction opposite to the arrow labeled "FRONT OF VEHICLE." This airflow serves to remove heat energy from liquid (anti-freeze) flowing through heat exchanger 12. In the embodiment shown in FIG. 1, the fan is located upstream of heat exchanger 12. However, depending upon the design configuration of the vehicle utilizing the heat exchanger assembly 10, support 18 and fan 16 may be supported to pull an airflow rather than force an airflow through heat exchanger 12.

Figure 2:
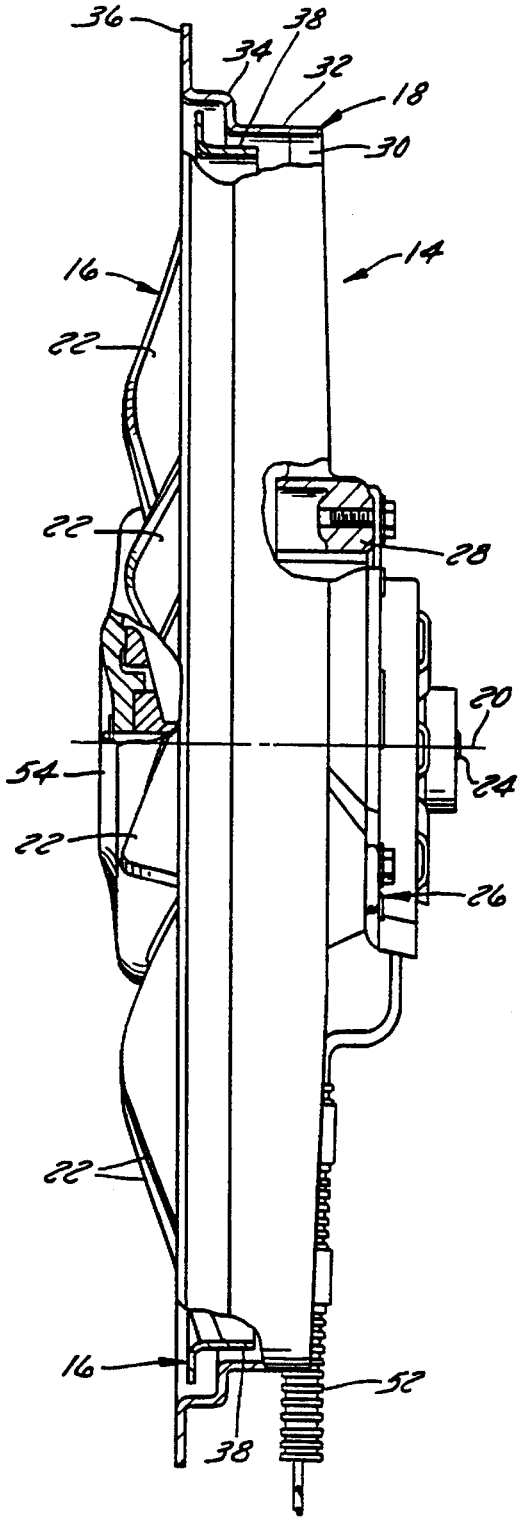
FIG. 2 is a side view of the airflow generator including a fan and fan support.
Figure 3:
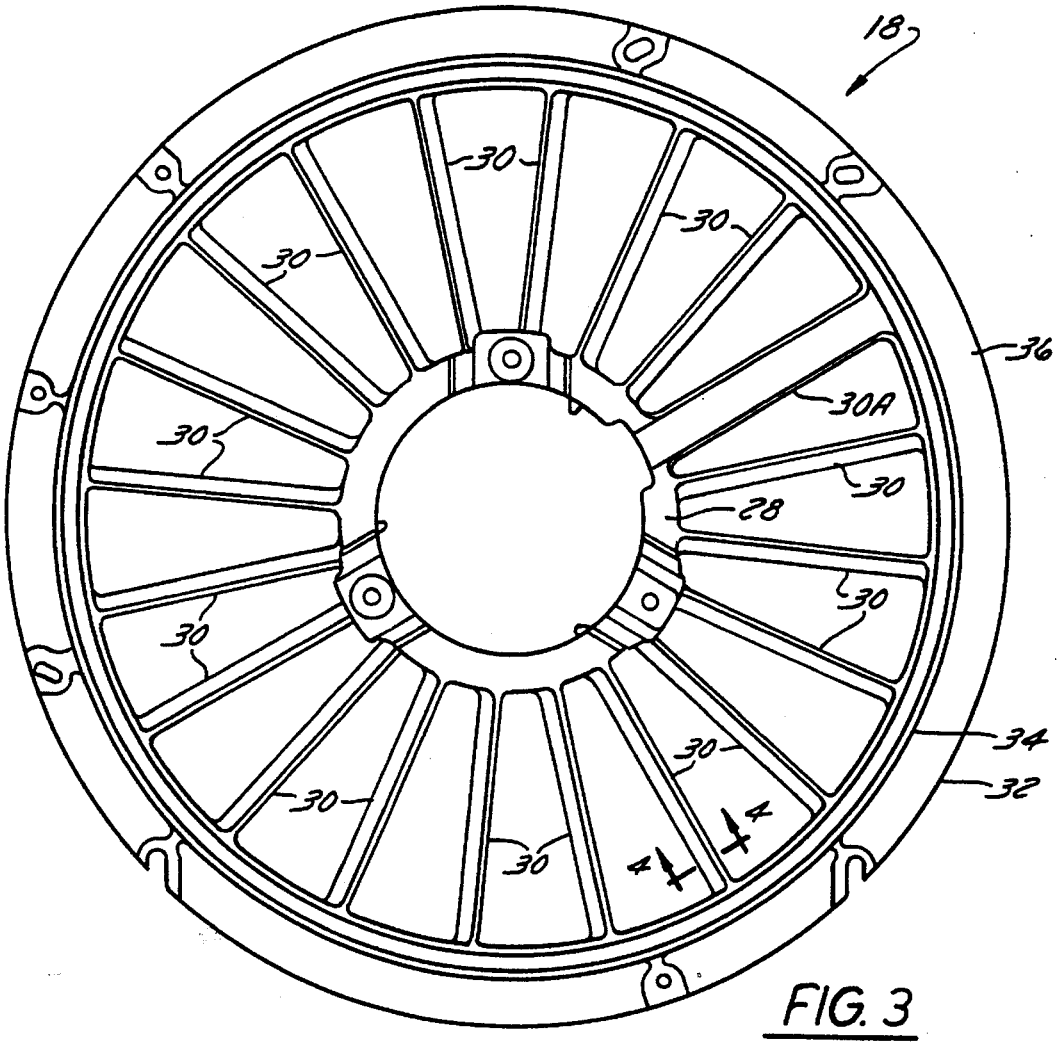
FIG. 3 is a rear view of the fan support.

Referring to FIGS. 2 and 3, the configuration of fan 16 and fan support 18 of airflow generator 14 is shown in detail. In particular, fan 16 includes eight radially-extending fan blades 22 configured to produce an airflow when fan 16 is rotated about rotational axis 20. This airflow includes components which are both parallel to axis 20 and at angles to axis 20. In particular, the components of the airflow may range from angles at between 90° and 0° to rotational axis 20. In general, fan 16 is rotatably supported by a shaft 24 and the bearing assembly of an electric motor 26. In the preferred embodiment, fan 16 is directly mounted to the shaft of fan motor 26. However, fan 16 could be mounted on a shaft independent of shaft 24 of motor 26 and powered by motor 26 through an appropriate transmission, such as a belt, chain or direct coupling drive.

Fan support 18 includes a central bearing or motor support 28 and twenty elongated airfoils 30 which are slightly longer than fan blades 22. Airfoils 30 extend between motor support 28 and a circumferential ring 32. Referring specifically to FIG. 2, ring 32 may include a circumferential flange 34 and a circumferential mounting flange 36. Flange 34 cooperates with a circumferential ring 38 of fan 16 to reduce or eliminate undesirable airflow components (i.e. recirculation) between fan support 18 and fan 16. Fan 16 is rotated about rotational axis 20 so that circumferential rings (bands) 32 and 38 are concentric to each other. Flange 36 provides a location for attaching fan support 18 to heat exchanger 12.

Figure 4:
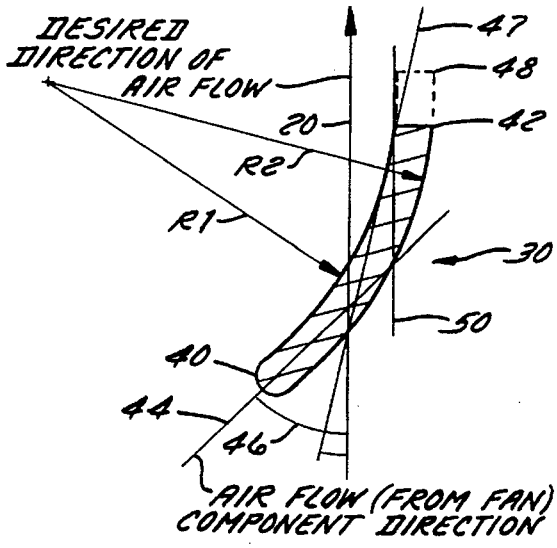
FIG. 4 is a sectional view of a stator airfoil taken along line 4–4 in FIG. 3.
Figure 5:
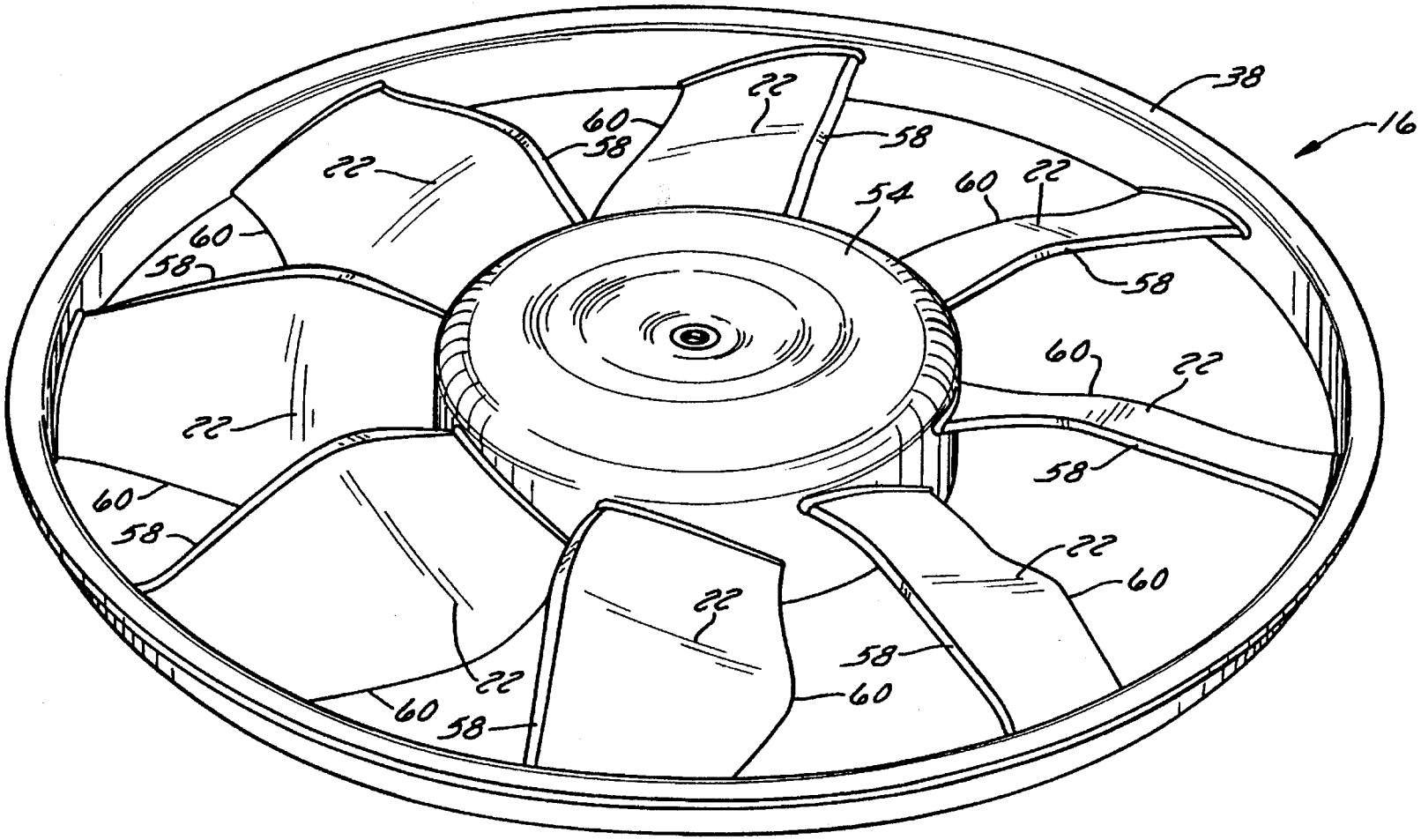
FIG. 5 is a perspective view of the fan.

Turning now to FIG. 4, which is a sectional view of a stator airfoil 30 taken along line 4—4 in FIG. 3, airfoils 30 are curved and have a rounded leading edge 40 and a trailing edge 42. In the preferred embodiment, a tangent 44 to the air guiding surface at leading edge 40 is at an angle 46 between the direction of airflow and rotational axis 20. For the present embodiment of fan 16, this angle is approximately 30°. However, depending upon the application, angle 46 could be between 15°–45°. A tangent 47 to the guiding surface of airfoil 30 at trailing edge 42 is at an angle to axis 20 which is less than angle 46. In the present embodiment of airfoil 30, this angle is in the range of 0°–45°, depending upon angle 46. However, where space constraints are not a problem, trailing edge 42 can be extended to edge 48 so that the tangent 50 to the guiding surface of airfoil 30 at trailing edge 42 is at an angle of approximately 0° to rotational axis 20 which is the path of the desired airflow direction.

Turning to an example of the cross-section of airfoil 30, airfoil 30 may have a constant thickness and a circular curve defined by radiuses R1 and R2, wherein the difference between R1 and R2 is the thickness of airfoil 30.

As discussed above, the present embodiment of airflow generator 14 includes an electric motor having a shaft which directly supports fan 16. Accordingly, electrical conductors 52 are required to provide power to electric motor 26. To reduce the noise generated by airflow generator 14, and aerodynamic cover 30A may be C-shaped as partially shown in FIG. 3 to cover the upstream side of conductors 52. This configuration of airfoil 30A reduces turbulence which may be caused by conductors 52 if airflow shielding is not provided.

Figure 6:
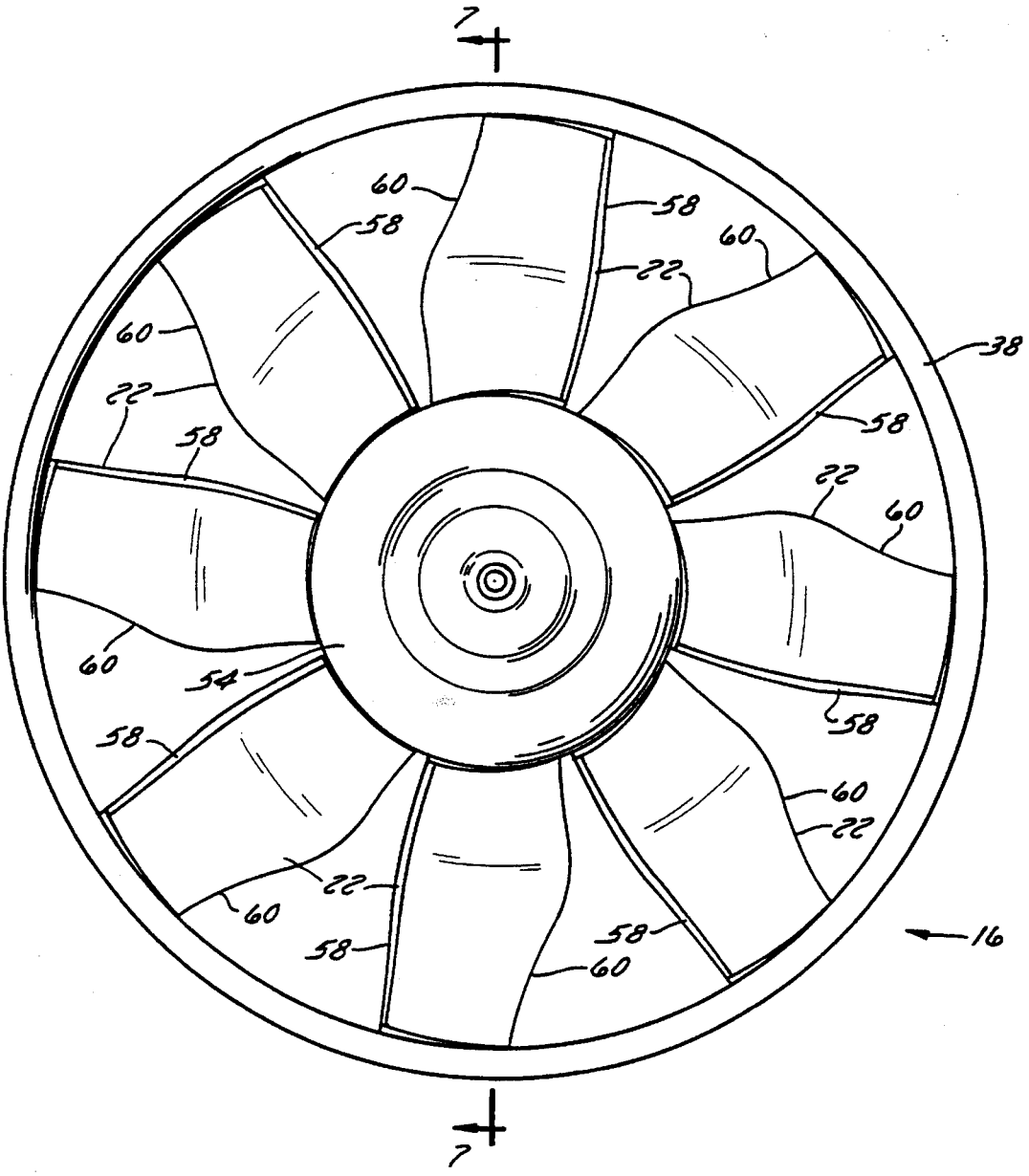
FIG. 6 is a front view of the fan.
Figure 7:
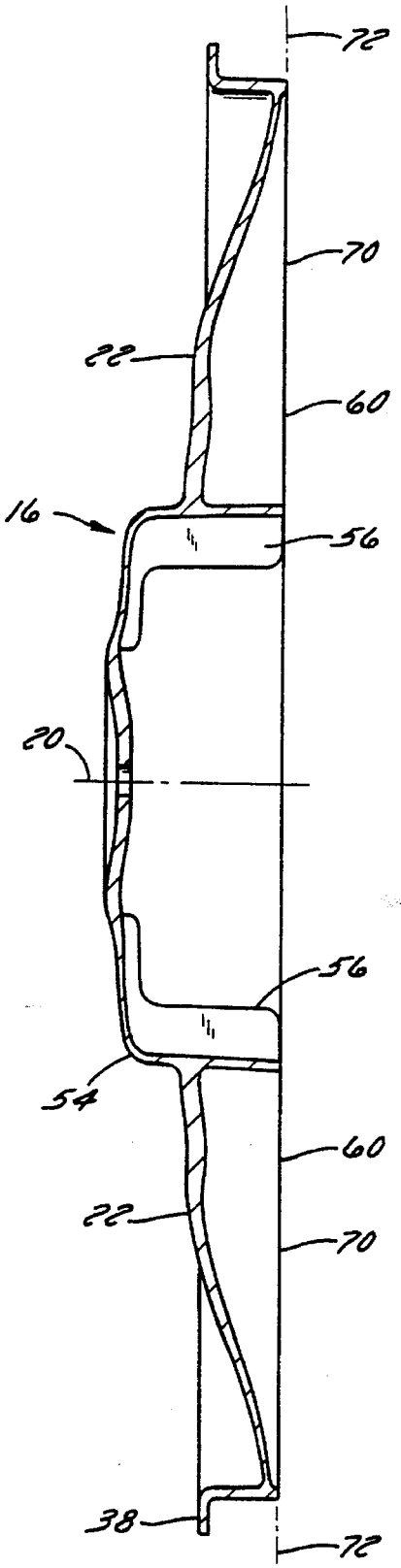
FIG. 7 is a sectional view of the fan taken along line 7–7 in FIG. 6.
Figure 8:
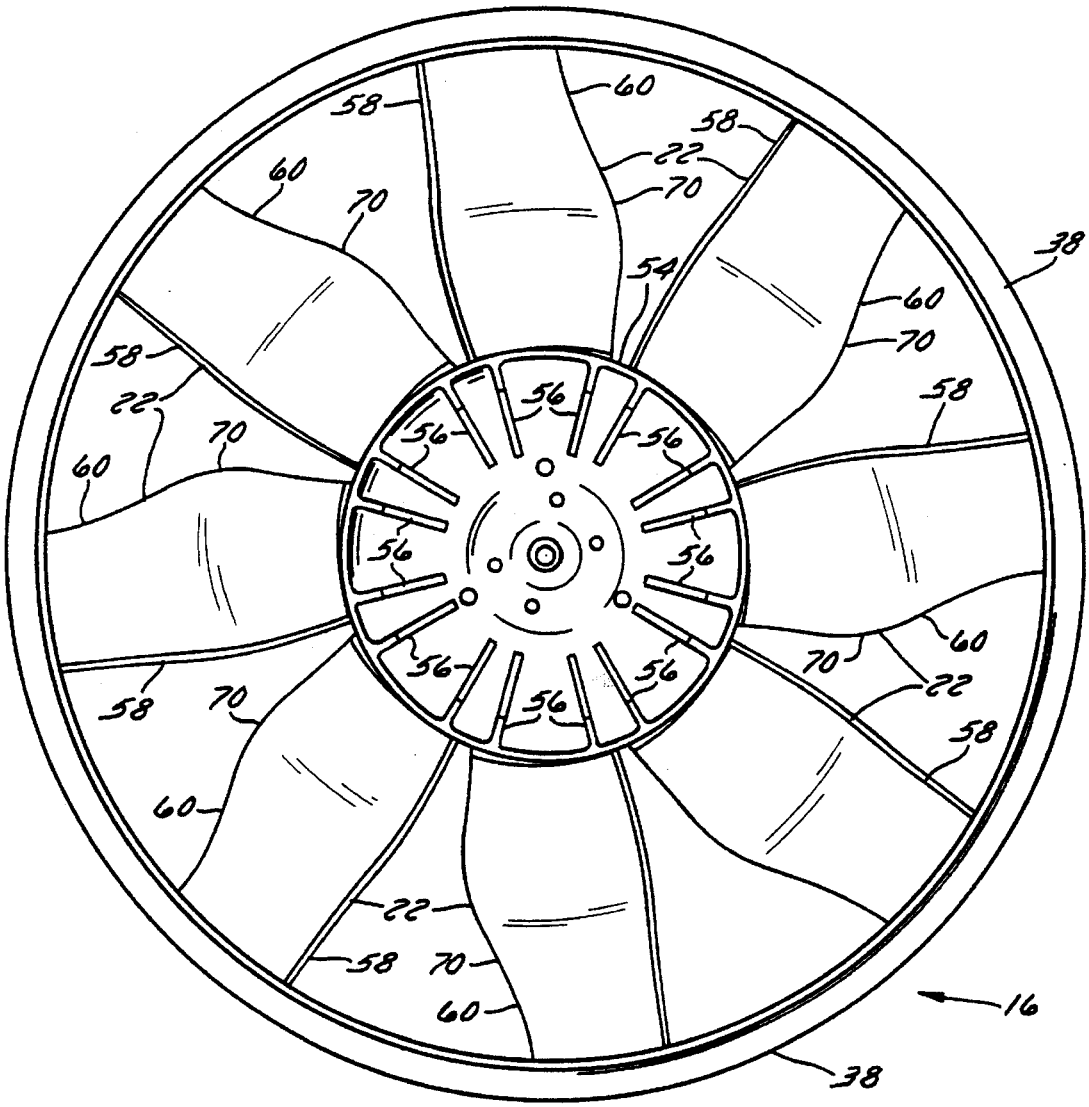
FIG. 8 is a rear view of the fan.

Referring to FIGS. 5–8, in addition to L-shaped circumferential ring 38 and fan blades 22, fan 16 includes a hub 54. Referring to FIG. 8 in particular, hub 54 includes a pair of reinforcement spars 56 located generally in the vicinity of the leading and trailing edges 58, 60 of fan blades 22. Fan blades 22 extend from hub 54 to ring 38 with this distance referred to as blade length. The torque required to rotate fan 16 is transmitted from hub 54 to fan blades 22 and ring 38. Spars 56 provide rigidity to fan 16, which aids in reducing vibration of fan 16 at frequencies which may create undesirable noise during the operation of fan 16. By way of example only, fan 16 may be an integrally molded piece fabricated from polycarbonate 20% G. F. Hydex 4320, or mineral and glass reinforced polyaimide 6/6 (e.g., du Pont Minlon 22C®).

Figure 9:
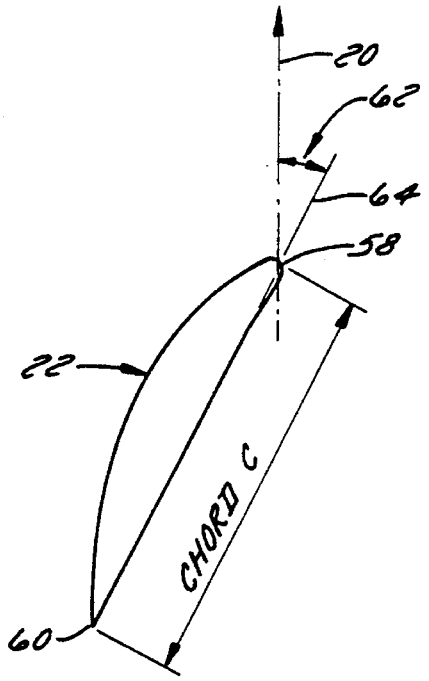
FIG. 9 is a schematic view representative of the orientation of a fan blade.

Referring to FIG. 9, this Figure illustrates the angles and pertinent portions of fan blades 22 in reference to a schematic cross-sectional view. In particular, edge 58 is the leading edge, and edge 60 is the trailing edge. The sectional view of the fan blade is shown in reference to rotational axis 20 and the desired direction of airflow which is parallel to axis 20. The chord C of the fan blade extends from leading edge 58 to trailing edge 60, and the stagger angle 62 is the angle between the rotational axis 20 and a line 64 extending from leading edge 58 to trailing edge 60.

Referring now to FIGS. 6 and 8, fan blades 22 are preferably equally spaced about hub 54. Fan blades 22 have a variable stagger angle, chord length and cross-sectional shape and area. In particular, the stagger angle varies from 70° at the hub to a minimum of 50° between 20% and 70% of the blade length from the hub (e.g., preferably 60%). Turning to the variable chord length, each fan blade has a maximum chord length which is approximately 44% of the length of blade 22 which occurs at a distance of between 20% and 70% of the blade (e.g., preferably 60%). The chord length at the hub is approximately 30% of the fan blade 22 length, and the chord length at ring 38 is approximately 30% of the fan blade 22 length. In the present embodiment of fan 16, the maximum cross-sectional area of blades 22 is at a distance from the hub corresponding to the maximum chord length.

Referring to FIGS. 7 and 8, each fan blade 22 includes a trailing edge 60 having a flat surface 70 which is coincident with a plane 72 perpendicular to the rotational axis 20 of fan 16. Flat surfaces 70 interact with the leading edges of airfoil 30 to provide improved performance and noise reduction when fan 16 operates in cooperation with fan support 18. Preferably, flat surface 70 extends along over 50% of the trailing edge 60 of fan blades 22.

By way of example only, the ratio of the area of the eight blades 22 of fan 16 projected on a plane perpendicular to rotational axis 20 to the area of the airfoils as projected on the same plane is approximately 0.3. Furthermore, ring 32 may be joined to a shroud which cooperates with ring 32 to provide a substantially closed airflow channel between heat exchanger 12 and fan 16. Furthermore, as with fan 16, fan support 18 may also be a single piece component molded from polycarbonate 20% G. F. Hydex 4320 or equivalent or mineral and glass reinforced polyaimide 6/6 (e.g., du Pont Minlon 22C®).

Turning again to the specific configuration of fan blades 22, these fan blades may have a C4 thickness form which possesses a circular arc camber line with additional nose camber based on an NACA 230 camber line. The cross-section for this type of airfoil may be calculated based upon the calculations set out in "Airfoil Section Data of *Axial Flow Fans and Ducts*", Wallace, R. Allen, pp. 425–429, John Wiley & Sons, Inc. (1983). More specifically, each fan blade 22 has approximately eight different C4 cross-section configurations extending from hub 54 to rim 38. To blend these cross-sectional configurations to produce a continuous blade from hub 54 to rim 38, spline interpolation functions are utilized. Of course, depending upon the accuracy desired, more than eight different cross-section or airfoil configurations may be used for fan blades 22. Additionally, each fan blade is offset from a line extending radially from axis 20 so that the distance from the leading edges of fan blades 22 to the radially extending lines is in the range of 15–35% of the total chord length of blade 22. This configuration improves fan efficiency and reduces noise. In particular, by positioning fan blades 22 relative to associated radial lines in this manner, the position of the low pressure peak relative to the high pressure peak associated with fan blades 22 is optimized.

It will be understood that the description above is of the preferred exemplary embodiment of the invention and that the invention is not limited to the specific forms shown and described. For example, L-shaped rim 38 interacts with L-shaped portion 34 of rim 32 to reduce recirculation between fan 16 and fan support 18. However, this L-shaped configuration may be replaced with other configurations which operate to reduce such circulation. By way of another example, the fan could be attached to the motor housing, where the motor shaft would be fixed to support 28. Thus, the fan would rotate with the motor housing rather than the motor shaft. Other substitutions, modifications, changes and omissions may be made in the design and arrangement of the preferred embodiment without departing from the spirit of the invention as expressed in the appended claims.

What is claimed is:

1. An airflow generator for producing an airflow across a heat exchanger comprising:

a fan rotatable about a rotational axis, the fan including a plurality of radially-extending fan blades configured to produce an airflow when the fan is rotated abut the rotational axis, wherein a component of the airflow occurs at a first angle to the rotational axis; and a fan support including a shroud assembly adapted to provide a substantially closed airflow channel between the fan and the heat exchanger, a central support at which the fan is rotatably supported and a plurality of elongated airfoils extending radially outward from the central support, each airfoil including a curved, airflow guiding surface having a leading edge and a trailing edge downstream from the leading edge, wherein a tangent to the guiding surface at the leading edge is substantially at the first angle to the rotational axis, and a tangent to the trailing edge is at a second angle to the rotational axis less than the first angle.

2. The generator of claim 1, wherein the fan blades have a cross-sectional shape which varies along the length of the blades.

3. The generator of claim 2, wherein the fan blades have a stagger angle which varies along the length of the blades.

4. The generator of claim 3, wherein the curve of the guiding surface is a generally circular arc and the thickness of the airfoils does not substantially vary along the arc.

5. The generator of claim 4, wherein the tangent to the trailing edge is substantially parallel to the rotational axis.

6. The generator of claim 5, wherein the airfoils are slightly longer than the blades.

7. The generator of claim 6, wherein the fan has eight blades and the fan support has twenty airfoils.

8. The generator of claim 7, wherein the ratio of the area of the blades as projected on a plane perpendicular to the rotational axis to the area of the airfoils as projected on the plane is approximately 0.3.

9. The generator of claim 1, further comprising an electric motor which includes a bearing assembly and shaft, wherein the shaft is attached to the fan and the bearing assembly is attached to the central support.

10. The generator of claim 9, wherein the electric motor is powered from at least one electrical conductor, and the support includes at least one aerodynamically shaped surface to cover the upstream side of the conductor.

11. An airflow generator comprising:

a fan rotatable about a rotational axis, the fan including a hub, a circular band and a plurality of fan blades equally spaced about the hub extending radially from the hub to the circular band, each fan blade having a variable stagger angle which is at its minimum value at a first predetermined distance from the hub less than the length of the blade, and each fan blade having a variable chord length which is at its maximum value at a second predetermined distance from the hub less than the length of the blade, the first and second predetermined distances being between 20 and 70 percent of the blade length, wherein when rotated about the rotational axis, the fan produces an airflow component at an angle to the rotational axis;

a fan support including a central bearing support and a plurality of airfoils extending radially outward from the bearing support, each airfoil being configured to guide a component of the airflow toward a path generally parallel with the rotational axis;

a bearing assembly attached to the fan support; and a shaft fastened to the fan and rotatably supported by the bearing assembly to support the fan for rotation about the rotational axis.

12. The airflow generator of claim 11, wherein the circular band has an L-shaped cross-section taken along a plane passing through the rotational axis.

13. The airflow generator of claim 12, wherein the fan support includes a circular band attached to the airfoils and concentrically located outside of the circular band of the fan.

14. The airflow generator of claim 13, wherein the airfoils are slightly longer than the fan blades.

15. The generator of claim 14, wherein the fan has eight blades and the fan support has twenty airfoils.

16. The generator of claim 15, wherein the ratio of the area of the blades as projected on a plane perpendicular to the rotational axis to the area of the airfoils as projected on the plane is approximately 0.3.

17. The generator of claim 16, further comprising an electric motor which includes the bearing assembly and shaft, wherein the bearing assembly is attached to the central bearing support.

18. The generator of claim 17, wherein the electric motor is powered from at least one electrical conductor, and the support includes at least one aerodynamically shaped surface to cover the upstream side of the conductor.

19. A heat exchanger assembly comprising:

a fan rotatable about a rotational axis, the fan including a hub, a circular band and a plurality of fan blades extending radially from the hub to the circular band, each fan blade having a variable stagger angle which is at its minimum value at a first predetermined distance of between 20 and 70 percent of the blade length from the hub, and each fan blade having a variable chord length which is at its maximum value at a second predetermined distance of between 20 and 70 percent of the blade length from the hub, the fan producing an airflow when rotated about the rotational axis, wherein a component of the airflow occurs at a first angle to the rotational axis;

a fan support including a central bearing support and a plurality of elongated airfoils extending radially outward from the bearing support, each airfoil including a curved airflow guiding surface having a leading edge and a trailing edge downstream from the leading edge, wherein a tangent to the guiding surface at the leading edge is substantially at the first angle to the rotational axis, and a tangent to the trailing edge is at a second angle to the rotational axis less than the first angle;

a heat exchanger, the fan support being supported relative to the heat exchanger to guide the airflow produced by the fan through the heat exchanger;

a bearing assembly attached to the fan support; and a shaft fastened to the fan and rotatably supported by the bearing assembly to support the fan for rotation about the rotational axis.

20. The generator of claim 19, wherein the fan blades have a cross-sectional shape which varies along the length of the blades, and the maximum cross-sectional area of the blades is at the second predetermined distance from the hub less than the length of the blades.

21. The assembly of claim 20, wherein the curve of the guiding surface is a generally circular arc and the thickness of the airfoils does not substantially vary along the arc.

22. The assembly of claim 20, wherein the tangent to the trailing edge is substantially parallel to the rotational axis.

23. The assembly of claim 20, wherein the airfoils are slightly longer than the blades.

24. The assembly of claim 23, wherein the fan has eight blades and the fan support has twenty airfoils.

25. The assembly of claim 24, wherein the ratio of the area of the blades as projected on a plane perpendicular to the rotational axis to the area of the airfoils as projected on the plane is approximately 0.3.

26. The assembly of claim 24, further comprising an electric motor which includes the bearing assembly and shaft, wherein the bearing assembly is attached to the central bearing support.

27. The assembly of claim 26, wherein the electric motor is powered from at least one electrical conductor, and the support includes at least one airfoil shaped to cover the upstream side of the conductor.

28. The assembly of claim 27, wherein each fan blade includes a trailing edge having a flat surface extending along at least 50% of the edge, the flat surfaces of each fan blade being coincident with a plane perpendicular to the rotational axis.

29. The assembly of claim 28, wherein the circular band has an L-shaped cross-section taken along a plane passing through the rotational axis.

30. The assembly of claim 29, wherein the fan support includes a circular band attached to the airfoils and concentrically located outside of the circular band of the fan.

31. A heat exchanger assembly comprising:

a fan rotatable about a rotational axis, the fan including a hub, a circular band and eight fan blades extending radially from the hub to the circular band, each fan blade having a variable stagger angle which is at its minimum value at a first predetermined distance of between 20 and 70 percent of the blade length from the hub, each fan blade having a variable chord length which is at its maximum value at a second predetermined distance of between 20 and 70 percent of the blade length from the hub, and each fan blade including a trailing edge having a flat surface extending along at least 50% of the edge, the flat surfaces of each fan blade being coincident with a plane perpendicular to the rotational axis, the fan producing an airflow when rotated about the rotational axis, wherein a component of the airflow occurs at a first angle to the rotational axis;

a fan support including a central bearing support and twenty elongated airfoils extending radially outward from the bearing support, each airfoil being slightly longer than the fan blades and including a curved airflow guiding surface having a leading edge and a trailing edge downstream from the leading edge, wherein the curve of the guiding surface is a generally circular arc, a tangent to the guiding surface at the leading edge is substantially at the first angle to the rotational axis, and a tangent to the trailing edge is at a second angle to the rotational axis less than the first angle;

a heat exchanger, the fan support being supported to guide the airflow produced by the fan through the heat exchanger;

an electric motor fastened to the central bearing support, the electric motor including a shaft fastened to the fan and rotatably supported by a bearing assembly to support the fan for rotation about the rotational axis; and at least one electrical conductor electrically coupled to the electric motor, wherein at least one airfoil is further shaped to cover the upstream side of the conductor.

32. The generator of claim 31, wherein the fan blades have a cross-sectional shape which varies along the length of the blades, and the maximum cross-sectional area of the blades is at the second predetermined distance from the hub less than the length of the blades.

33. The assembly of claim 32, wherein the tangent to the trailing edge is substantially parallel to the rotational axis.

34. The assembly of claim 33, wherein the ratio of the area of the blades as projected on a plane perpendicular to the rotational axis to the area of the airfoils as projected on the plane is approximately 0.3.

35. The assembly of claim 34, wherein the circular band has an L-shaped cross-section taken along a plane passing through the rotational axis.

36. The assembly of claim 35, wherein the fan support includes a circular band attached to the airfoils and concentrically located outside of the circular band of the fan.

* * * * *